United States Patent [19]

Tan et al.

[11] 4,342,542

[45] Aug. 3, 1982

[54] MOVING BLADE OF STEAM TURBINE

[75] Inventors: Toshimi Tan; Katsukuni Hisano; Takao Mizoi, all of Hitachi, Japan

[73] Assignee: Hitachi, Ltd., Tokyo, Japan

[21] Appl. No.: 90,435

[22] Filed: Nov. 1, 1979

[30] Foreign Application Priority Data

Nov. 10, 1978 [JP] Japan ..... 53/137911

[51] Int. Cl.[3] ..... F01D 5/14

[52] U.S. Cl. ..... 416/224

[58] Field of Search ..... 416/224, 223, 228

[56] References Cited

U.S. PATENT DOCUMENTS 3,412,611 11/1968 Eccles et al. ..... 416/223
3,561,886 2/1971 Kreischer, Jr. et al. ..... 416/224
3,796,513 3/1974 Jonas ..... 416/224

FOREIGN PATENT DOCUMENTS 964810 3/1975 Canada ..... 416/224

*Primary Examiner*—William L. Freeh
*Attorney, Agent, or Firm*—Craig and Antonelli

[57] ABSTRACT

A moving blade for use in a steam turbine has a turbine rotor carrying a multiplicity of radially outwardly extending moving blades, each moving blade being provided at its leading edge of the radially outer end thereof with an anti-erosion plate attached by welding. The turbine blade has thicknesswise protrusions formed on both surfaces thereof at a portion near the base of the anti-erosion plate where it is attached to the moving blade. Thanks to these thicknesswise protrusions, the moving blade has such a radial distribution of cross-sectional area that the cross-sectional area is greater at the portion where the thicknesswise protrusions are formed than at other portions which are adjacent to the above-mentioned portion of the moving blade in the radial direction. As a result, the stresses at the portion of the moving blade near the base of the anti-erosion plate are reduced.

3 Claims, 5 Drawing Figures

MOVING BLADE OF STEAM TURBINE

BACKGROUND OF THE INVENTION

The present invention relates to moving blades of a steam turbine and, more particularly, to a novel construction of the moving blades of the steam turbines. Still more particularly, the invention is concerned with a turbine moving blade having an anti-erosion plate.

The current tendency of increased capacity and compacting of steam turbines gives rise to the demand for larger length of moving blades of the final stage in the low pressure part of the steam turbine, which in turn increases the centrifugal force exerted on the moving blades during rotation of the rotor to such an extent as would not be withstood by 12%-Cr steel which is the typical conventional material of the moving blades of steam turbines.

As will be described later with reference to the drawings, the maximum stress caused in the moving blades by the centrifugal force can be reduced almost to a half by using Ti-alloy steel as the material of the moving blades in place of the conventionally used 12% Cr-steel.

It is, therefore, a current measure to use the Ti-alloy steel as the material of the moving blades of the final stage in the low pressure part of the steam turbine. When the Ti-alloy steel is used as the material of the moving blades of the final stage in the low pressure part of the steam turbine, an anti-erosion plate is welded to the leading edge of each of such moving blades, in order to protect these moving blades against erosion which may be caused by the steam drain particles contained in the steam.

Usually, this anti-erosion plate is made of a Co-W alloy steel. Since this alloy steel has a specific weight of 8 to 8.5 which is about twice as large as that of the Ti-alloy steel, stresses of a high level are generated at the base of the anti-erosion plate. In order to diminish these stresses, it has been proposed to provide a protrusion projecting toward the steam inlet side from the leading edge of the moving blade of the steam turbine at the base of the anti-erosion plate to increase the width of the blade thereby to reduce the stresses generated at the base of the anti-erosion plate.

According to this countermeasure, however, it is necessary that the above-mentioned protrusion has a considerably large size to make a blade width sufficiently large to uniformly eliminate a drastic increase of the stresses at the base of the anti-erosion plate. This inconveniently results in a large reduction of the turbine efficiency due to the profile loss. It is also to be pointed out that the erosion is increased at the protrusion formed on the leading edge of the moving blade. In addition, the deformation of the moving blade during welding is increased because of the increase of the length of weld between the anti-erosion plate and the moving blade made of Ti-alloy steel.

SUMMARY OF THE INVENTION

It is, therefore, an object of the invention to provide a moving blade of a steam turbine in which the stresses occurring in the moving blade near the base of the anti-erosion plate is decreased without incurring the profile loss of the blade.

To this end, according to the invention, there is provided a moving blade for use in a steam turbine having a multiplicity of moving blades extending radially outwardly from a turbine rotor, each of the moving blades being provided at its radially outer end portion and at the steam inlet side with an anti-erosion plate, wherein each moving blade has protrusions protruding in the thicknesswise direction of the moving blade, the protrusions being formed on the wall of the moving blade at a portion of the latter near the base of the anti-erosion plate where it is attached to the moving blade at the end closer to said turbine rotor such that the cross-sectional area of the moving blade is greater at the portion of the blade where the protrusions are formed than at other portions adjacent to said portion of the blade in the radial direction, whereby the stresses at the portions of the blade near the base of the anti-erosion plate is reduced.

DESCRIPTION OF THE PREFERRED EMBODIMENT

Figure 1:
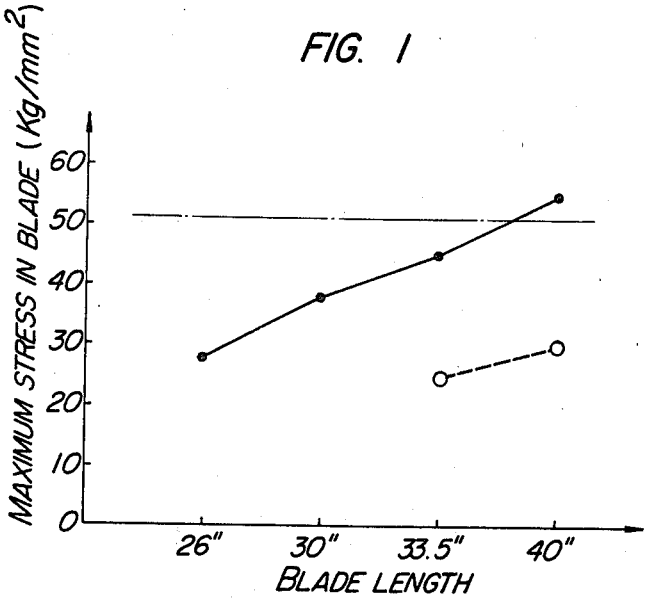
FIG. 1 is a chart showing the relationship between the blade length of a moving blade of a conventional steam turbine and the maximum stress occurring in the moving blade.

FIG. 1 shows the maximum stresses caused in the moving blades having lengths of between 26 in. and 40 in. due to the centrifugal force generated at a 3600 r.p.m. rotation. The maximum allowable stress line for 12% Cr steel is shown by one-dot-and-dash line. It will be seen that the 12% Cr steel can be used for blades having a blade length not greater then 33.5 in. However, the maximum stress in the moving blade exceeds the maximum allowable stress when the moving blade has a length greater than 40 in. For this reason, a Ti-alloy steel containing 5 to 6% of aluminum is used as the material of the moving blade having a large blade length. The Ti-alloy steel has a specific weight of 4.4 to 4.5, which is about a half of that of the 12% Cr steel, so that the maximum stress in the moving blade can be reduced almost to a half as shown by a broken line in FIG. 1.

Hereinafter, a description will be made as to a preferred embodiment of the invention.

Generally, the centrifugal force generated in the turbine moving blade is given as a product of the weight (mass), radius and the square of the angular velocity. Thus, the centrifugal force is increased in proportion to the radius. However, since the turbine moving blade is narrowed toward its radially outer end, the weight of the blade becomes smaller toward its radially outer end. The stress in the turbine moving blade caused by the centrifugal force is a function of the cross-sectional area of the blade. It is, therefore, possible to reduce the stresses at the portion of the moving blade near the base of the anti-erosion plate by increasing the cross-sectional area of the moving blade at that portion. In this connection, it is to be pointed out that, for ensuring the good efficiency of the moving blade, it is necessary that the leading edge thereof has a gentle curve over its length from the radially inner end to the radially outer end of the moving blade to preserve the original shape of the blade profile.

Under the circumstances, the present invention proposes to form protrusions projecting in the thicknesswise direction, as a measure for satisfying both of requirements of the reduction of stress at the portion of the moving blade near the base end of the anti-erosion plate and the preservation of the original shape of the blade profile.

Figure 2:
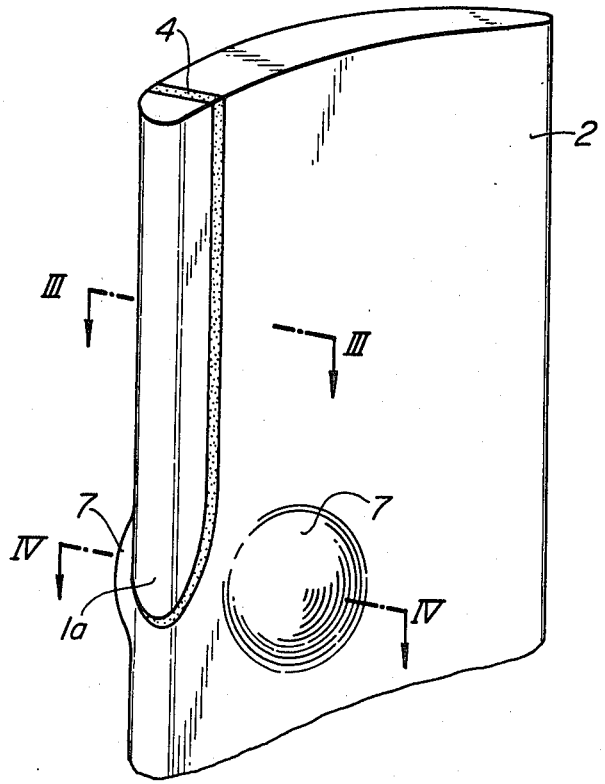
FIG. 2 is a perspective view of a moving blade of a turbine made of a Ti alloy steel, constructed in accordance with an embodiment of the invention.

FIG. 2 shows the shape of a turbine moving blade which is an embodiment of the invention. In this embodiment, as in the case of the conventional moving blade having an anti-erosion plate, the moving blade 2 made of a Ti-alloy is provided at its leading edge of the radially outer part thereof with an anti-erosion plate 1 made of a Co-W alloy steel attached by welding 4. However, according to the invention, the moving blade 2 is provided, in the vicinity of a portion or base 1*a* of the anti-erosion plate 1 where it is attached to the moving blade 2 at the end closer to a turbine rotor with protrusions 7 projecting from both sides of the moving blade in the thicknesswise direction of the latter. Each of the protrusions 7 has a curved surface and an arcuate cross-sectional shape. The shape of this protrusion 7 will be more clearly understood from FIGS. 3 and 4 which are cross-sectional views of the turbine blade taken along the lines III—III and IV—IV of FIG. 2.

Figure 3:
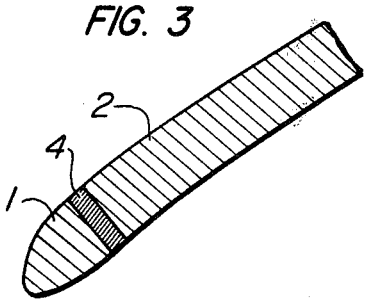
FIG. 3 is a sectional view taken along the line III—III of FIG. 2.
Figure 4:
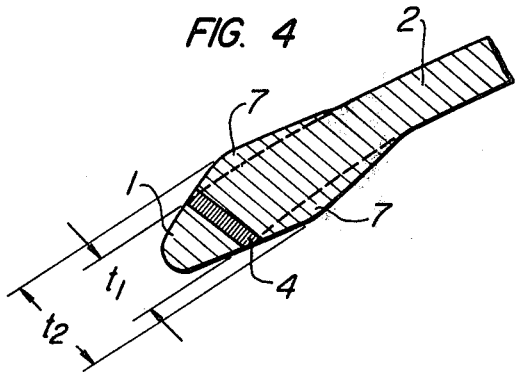
FIG. 4 is a sectional view taken along the line IV—IV of FIG. 2.

As will be apparent from FIG. 3, the anti-erosion plate 1 has a thickness substantially equal to that of the moving blade 2 made of Ti-alloy steel, over the length of the plate 1 between a point radially outside of the portion 1*a* and the radially outer extremity. The moving blade 2 is formed with the protrusions 7 which project from both sides thereof in the vicinity of the portion 1*a* of the anti-erosion plate 1, in the thicknesswise direction of the moving blade 2. Due to this, as shown in FIG. 4, the maximum thickness $t_2$ of a portion of the moving blade 2 where the protrusions 7 are formed is greater than the maximum thickness $t_1$ of the anti-erosion plate 1. By forming the protrusions 7 having arcuate cross-sections, the moving blade 2 has a greater cross-sectional area at a portion thereof near the base 1*a* of the anti-erosion plate than at other portions thereabout. Thanks to this inreased cross-sectional area, the undesirable drastic increase of the stress in the vicinity of the base 1*a* of the anti-erosion plate 1 is fairly avoided.

The turbine moving blade having protrusions protruded in the thicknesswise direction of the blade will be compared with the conventional moving blade having an increased blade width.

A turbine blade is assumed here to originally have an effective length of 40 to 41 in., overall width including the anti-erosion plate 1 of 100 mm, mean thickness of 8 mm, and a width of anti-erosion plate 1 of 15 mm. It is possible to reduce the stresses near the base 1*a* of the anti-erosion plate 1 to a level substantially equal to the level of stresses around the base 1*a*, if the mean thickness of the moving blade at the portion thereof where the protrusions 7 are formed is increased to about 12 mm, in case where protrusions 7 having an arcuate cross-sectional shape as shown in FIG. 4 are formed. Namely, it is sufficient to increase the mean thickness of the moving blade by about 4 mm. On the other hand, in the conventional moving blade having an increased blade width, the overall width of the moving blade must be increased to 120 mm by providing a projection of about 20 mm in the widthwise direction of the moving blade, in order to obtain an increase of the cross-sectional area equal to that attained by the present invention.

It will be clear to those skilled in the art that this widthwise projection in the conventional moving blade incurs a considerably large reduction of the efficiency due to the profile loss.

According to the invention, the stress caused in the portion of the moving blade near the base 1*a* of the anti-erosion plate 1 may be made smaller by increasing the thickness of the protrusions 7 in the thicknesswise direction of the moving blade.

The optimum blade thickness is given by the following equation:

$$1.1\ t_1 < t_2 < t_1 \times (\gamma_s/\gamma_T)$$

where $t_2$: the maximum thickness of the moving blade at the portion thereof where protrusions 7 are formed $t_1$: the maximum thickness of the anti-erosion plate 1

$\gamma_s$: the specific weight of the anti-erosion plate 1

$\gamma_T$: the specific weight of the turbibone moving blade 2 made of Ti-alloy steel.

Figure 5:
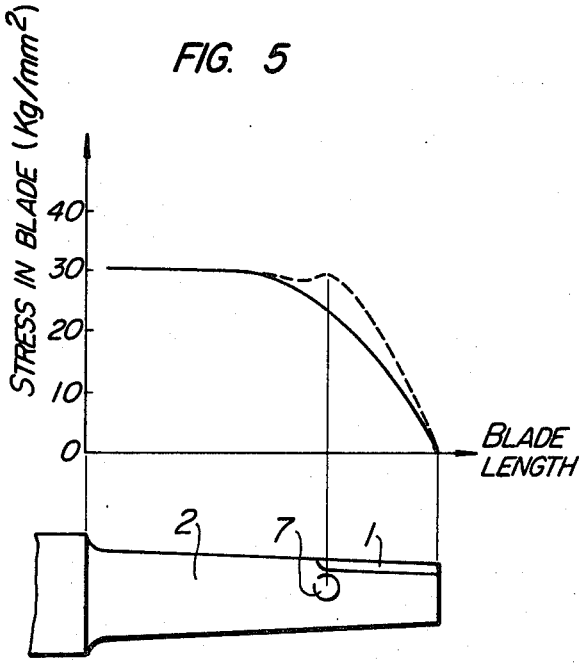
FIG. 5 is a chart showing the relationship between the blade length of a turbine moving blade of the invention and the stress in the moving blade.

FIG. 5 shows the stress distribution in the moving blade when the protrusions 7 are formed.

As will be seen from this Figure, the stresses in the moving blade near the base 1*a* of the anti-erosion plate 1 is remarkably reduced by the provision of the thicknesswise protrusions 7, as compared with the conventional moving blade the stress in which is shown by a broken-line curve.

Thus, according to the invention, it is possible to obtain a desirable stress distribution in the moving blade by the provision of the thicknesswise protrusions. In addition, no substantial decrease of the efficiency is caused by the slight increase of the blade thickness attributable to the formation of the thicknesswise protrusions. Also, the thermal distortion of the moving blade due to the welding of the anti-erosion plate 1 is decreased thanks to the increased thickness of the moving blade. Also, according to the invention, it is possible to use an anti-erosion plate having a substantially linear shape, which in turn permits an easy manufacturing of the anti-erosion plate, as well as reduction of number of steps of the moving blade manufacturing process, to provide a turbine moving blade of an increased safety and reliability.

As has been described, according to the invention, the stresses occurring in the portions of the moving blade near the base of the anti-erosion plate is sufficiently reduced, without being accompanied by the increase of the profile loss of the blade, thanks to the increase of the cross-sectional area of the turbine moving blade at that portion provided by the thicknesswise protrusions.

What is claimed is:

1. A moving blade for use in a steam turbine having a turbine rotor, a plurality of radially outwardly extending moving blades provided on the turbine rotor, each moving blade being provided at a leading edge of a radially outer end portion thereof with an anti-errosion plate, protrusion means projecting in a thicknesswise direction of said moving blade provided on both sides of a portion of said moving blade in a vicinity of a base of said anti-errosion plate where the anti-errosion plate is attached to said moving blade at an end closer to said turbine rotor for relieving stress at said portion of the moving blade and for preserving an original profile shape of the blade, each of said protrusion means having a surface of curvature of an arcuate cross-sectional configuration, said moving blade having a radial distribution of cross-sectional area such that the cross-sectional area is greater at said portion where said protrusion means are formed than at any other portions which are adjacent to said portion of said moving blade, as viewed in a radial direction.

2. A moving blade for use in a steam turbine as claimed in claim 1, wherein a maximum thickness $t_2$ of said moving blade at the portion where said protrusion means are formed meets the following conditions:

$$1.1\ t_1 < t_2 < t_1 \times (\gamma_S/\gamma_T).$$

where, $t_1$=a maximum thickness of the anti-errosion plate, $\gamma_S$=a specific weight of the anti-errosion plate, $\gamma_T$=a specific weight of the moving blade.

3. A moving blade of a steam turbine as claimed in claim 1 or 2, wherein said moving blade is made of a Ti-alloy steel.

* * * * *